US010314329B2

(12) United States Patent
Uchii et al.

(10) Patent No.: US 10,314,329 B2
(45) **Date of Patent: *Jun. 11, 2019**

(54) ORAL TOBACCO COMPOSITION AND PRODUCTION METHOD THEREOF

(71) Applicant: JAPAN TOBACCO INC., Tokyo (JP)

(72) Inventors: Kimitaka Uchii, Tokyo (JP); Takuma Nakano, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 87 days.

This patent is subject to a terminal disclaimer.

(21) Appl. No.: 15/493,724

(22) Filed: Apr. 21, 2017

(65) Prior Publication Data

US 2017/0224010 A1 Aug. 10, 2017

Related U.S. Application Data

(63) Continuation of application No. PCT/JP2015/051769, filed on Jan. 23, 2015.

(30) Foreign Application Priority Data

Oct. 24, 2014 (WO) ..... PCT/JP2014/078402

(51) Int. Cl.

| | |
|---|---|
| ***A24B 15/24*** | (2006.01) |
| ***A24B 15/28*** | (2006.01) |
| ***A24B 15/10*** | (2006.01) |
| ***A24B 13/00*** | (2006.01) |
| ***A24B 15/18*** | (2006.01) |

(52) U.S. Cl.

CPC ..... *A24B 15/241* (2013.01); *A24B 13/00* (2013.01); *A24B 15/10* (2013.01); *A24B 15/18* (2013.01); *A24B 15/287* (2013.01)

(58) Field of Classification Search

None

See application file for complete search history.

(56) References Cited

U.S. PATENT DOCUMENTS 4,150,677 A * 4/1979 Osborne, Jr. ..... A24B 15/24 131/275

5,018,540 A 5/1991 Grubbs et al.

(Continued)

FOREIGN PATENT DOCUMENTS

EP 2 377 413 A1 10/2011

GB 2 031 707 A 4/1980

(Continued)

OTHER PUBLICATIONS

English tranlsation of International Preliminary Report on Patentability and Written Opinion dated May 4, 2017, in PCT International Application No. PCT/JP2015/051769.

(Continued)

*Primary Examiner* — Dennis R Cordray

(74) *Attorney, Agent, or Firm* — Birch, Stewart, Kolasch & Birch, LLP

(57) ABSTRACT

An oral tobacco composition in which sensations to the throat and esophagus that are characteristic of raw tobacco are selectively removed, and a production method thereof are provided. Provided is an oral tobacco composition in which the ratio of total content of one or more of citric acid, malic acid, succinic acid, acetic acid and formic acid to the nicotine content (A/N) is 1.30 or less.

11 Claims, 3 Drawing Sheets

(56) References Cited

U.S. PATENT DOCUMENTS

| | | | | |
|---|---|---|---|---|
| 5,038,802 | A * | 8/1991 | White | A24B 15/24 131/275 |
| 5,235,992 | A | 8/1993 | Sensabaugh, Jr. | |
| 5,445,169 | A * | 8/1995 | Brinkley | A24B 15/24 131/297 |
| 6,584,980 | B1 | 7/2003 | Russo | |
| 9,375,033 | B2 * | 6/2016 | Lampe | A23G 4/068 |
| 2007/0023058 | A1 | 2/2007 | Howell et al. | |
| 2010/0247612 | A1 * | 9/2010 | Fuisz | A24B 3/18 424/443 |
| 2012/0247492 | A1 | 10/2012 | Kobal et al. | |
| 2012/0298124 | A1 | 11/2012 | Shikata et al. | |
| 2012/0318287 | A1 | 12/2012 | Andersen | |

FOREIGN PATENT DOCUMENTS

| | | | |
|---|---|---|---|
| JP | 2002-501768 | A | 1/2002 |
| JP | 2013-523092 | A | 6/2013 |
| WO | WO 2011/093304 | A1 | 1/2002 |
| WO | WO 2007/053096 | A1 | 5/2007 |
| WO | WO 2013/146952 | A1 | 10/2013 |

OTHER PUBLICATIONS

Leffingwell et al., "Tobacco: Production, Chemistry and Technology, Chapter 8: 8 A Basic Chemical Constituents of Tobacco Leaf and Differences among Tobacco Types," May 1, 1999, Blackwell Science Ltd., Oxford, GB, pp. 265-284 (p. 280; Fig. 8.21; Table 8.11).

Partial Supplementary European Search Report dated May 24, 2018, in European Patent Application No. 15851968.6.

International Search Report (PCT/ISA/210), issued in PCT/JP2015/051769, dated Apr. 7, 2015.

Written Opinion of the International Searching Authority (PCT/ISA/237), issued in PCT/JP2015/051769, dated Apr. 7, 2015.

Chen et al., "Forming tobacco product component with vanilla aroma characteristic involves cutting sample/heating in glass storage device/blowing nitrogen/processing/collecting . . . ," WPI 2017 Clarivate Analytics, vol. 2014, No. 27, (Feb. 19, 2014) XP002781324.

Extended European Search Report dated Sep. 17, 2018, in European Patent Application No. 15851968.6.

Feng, S: "Prepn. of nicotine prods. from tobacco—by adding caustic soda soln. and dry distn. in airtight pot," WPI 2017 Clarivate Analytics, vol. 1992, No. 11, (Apr. 10, 1991), XP002781325.

* cited by examiner

ORAL TOBACCO COMPOSITION AND PRODUCTION METHOD THEREOF

CROSS REFERENCE TO RELATED APPLICATIONS

This application is a Continuation of PCT International Application No. PCT/JP2015/051769, filed on Jan. 23, 2015, which claims priority under 35 U.S.C. 119(a) to Patent Application No. PCT/JP2014/078402, filed on Oct. 24, 2014, all of which are hereby expressly incorporated by reference into the present application.

BACKGROUND OF THE INVENTION

The present invention relates to an oral tobacco composition and to a production method thereof.

FIELD OF THE INVENTION

Oral tobacco compositions such as snus and tobacco gum are conventionally known. During use, these existing oral tobacco compositions are known to give rise to a characteristic feel as an unpleasant sensation extending from the throat towards the esophagus and breast of a user, and this causes some users to avoid using the compositions.

Various approaches have been studied in order to mitigate this sensation. Japanese Translation of PCT Application No. 2013-523092 discloses the feature of including an active component such as mercaptan or camphor in order to reduce the characteristic feel in the mouth derived from smokeless tobacco. Japanese Translation of PCT Application No. 2002-501768 discloses the feature of adding vitamin E or a succinate thereof in order to reduce the characteristic feel in the mouth derived from smokeless tobacco.

SUMMARY OF THE INVENTION

In both inventions of the citations, a special additive is used in order to reduce the feel in the throat and esophagus characteristic of oral tobacco compositions. It has proven very difficult to reduce the feel in the throat and esophagus characteristic of oral tobacco compositions without using such special additives.

It is an object of the present invention, arrived at in the light of the above problems, to provide an oral tobacco composition that allows reducing the feel in the throat and esophagus that is characteristic of a tobacco material, without relying on the use of special additives.

As a result of diligent research, the inventors found that the feel in the throat and esophagus that is characteristic of a tobacco material can be selectively reduced in an oral tobacco composition having a ratio (A/N ratio) of total content of one or more acids selected from the group consisting of citric acid, malic acid, succinic acid, acetic acid and formic acid of 1.30 or lower with respect to the content of nicotine, which is known as a representative flavor component and which can be measured in a convenient manner, and arrived at the present invention on the basis of that finding.

Specifically, the present invention is as follows.

[1] An oral tobacco composition, wherein a ratio (A/N ratio) of total content of one or more acids selected from the group consisting of citric acid, malic acid, succinic acid, acetic acid and formic acid with respect to content of nicotine is 1.30 or lower.

[2] The oral tobacco composition of [1], wherein the A/N ratio is 0.05 or higher.

[3] The oral tobacco composition of [1] or [2], wherein the A/N ratio is 0.20 or lower.

[4] The oral tobacco composition of any one of [1] to [3], wherein pH of the oral tobacco composition is from 8.0 to less than 10.0.

[5] A method for producing an oral tobacco composition that contains a tobacco material obtained through steps a) to e) below:

a) step of adding a basic substance to a tobacco material;

b) step of heating the tobacco material, to which the basic substance has been added, to cause a flavor component in the tobacco material to be released into a gas phase;

c) step of recovering the flavor component having been released into the gas phase;

d) step of washing by using a washing solvent the tobacco material, from which the flavor component has been released, to remove thereby an acidic substance remaining in the tobacco material; and e) step of, after d), returning the flavor component recovered in c) to the tobacco material.

[6] The production method of [5], wherein the basic substance contains an alkali metal salt of weak acid.

[7] The production method of [6], wherein the alkali metal salt of weak acid is an alkali metal salt of carbonic acid.

[8] The production method of any one of [5] to [7], wherein total content of saccharides in the tobacco material is 10.0 wt % or less with respect to 100 wt % as total weight of the tobacco material in a dry state.

[9] The production method of any one of [5] to [8], wherein in step a) the basic substance is added to the tobacco material so that pH of the tobacco material reaches a range of 8.9 to 9.7.

[10] The production method of any one of [5] to [9], wherein the washing solvent is water and/or carbonated water, or an aqueous solution containing supersaturated $CO_2$ gas.

[11] The production method of any one of [5] to [10], wherein a ratio (A/N ratio) of total content of one or more acids selected from the group consisting of citric acid, malic acid, succinic acid, acetic acid and formic acid with respect to content of nicotine in the obtained tobacco material is 2.00 or lower.

[12] The production method of any one of [5] to [11], wherein a ratio (A/N ratio) of total content of one or more acids selected from the group consisting of citric acid, malic acid, succinic acid, acetic acid and formic acid with respect to content of nicotine in the obtained tobacco material is 1.30 or lower.

[13] The production method of any one of [5] to [12], wherein a ratio (A/N ratio) of total content of one or more acids selected from the group consisting of citric acid, malic acid, succinic acid, acetic acid and formic acid with respect to content of nicotine in the obtained tobacco material is 0.05 or higher.

An oral tobacco composition and a production method thereof can be provided in which there is reduced the feel in the throat and esophagus that is characteristic of a tobacco material.

Further features of the present invention will become apparent from the following description of exemplary embodiments (with reference to the attached drawings).

DESCRIPTION OF THE EMBODIMENTS

Figure 1:
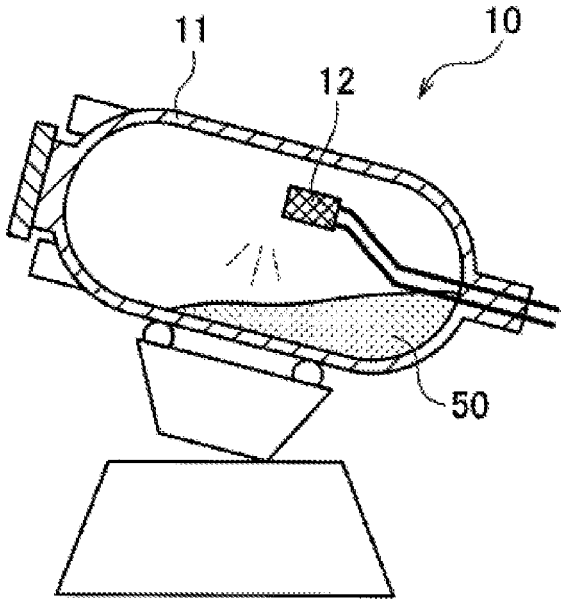
FIG. 1 is a diagram illustrating an example of an apparatus that can be used in a heating treatment.

The present invention will be explained next in detail on the basis of embodiments, examples and so forth. However, the present invention is not limited to the embodiments, examples and the like below, and may accommodate arbitrary modifications without departing from the gist of the invention.

The tobacco leaf material that the oral tobacco composition of the present invention can contain is not particularly limited, so long as the below-described A/N ratio ranges are satisfied when the tobacco leaf material is made into a composition for tobacco. Herein there can be used, specifically, the shredded tobacco leaf or powder that is used in the below-described method for producing an oral tobacco composition of the present invention. In terms of width of the shredded tobacco leaf and granularity of the tobacco powder there can be used a shredded tobacco leaf or powder similar to those that are used in the below-described method for producing an oral tobacco composition of the present invention.

In the oral tobacco composition of the present invention, a ratio (A/N ratio) of total content of one or more acids selected from the group consisting of citric acid, malic acid, succinic acid, acetic acid and formic acid with respect to the content of nicotine in the oral tobacco composition is 1.30 or lower.

In the present invention content ratio denotes molar ratio.

By virtue of the fact that the A/N ratio in the oral tobacco composition is 1.30 or lower it becomes possible to reduce the feel in the throat and esophagus (hereafter also referred to simply as characteristic feel), during use of the oral tobacco composition, as compared with that of a conventional oral tobacco composition. In another implementation, the A/N ratio may be 0.20 or lower, with a view to further reducing the characteristic feel. The oral tobacco composition of the present invention exhibits no difference with respect to conventional oral tobacco compositions as regards desirable sensations other than the above characteristic feel of the tobacco material, and it is only the characteristic feel that is selectively reduced herein. The present invention allows the characteristic feel to be reduced selectively even without using the additives disclosed in the citations, and hence desirable sensations other than the characteristic feel are not suppressed, and the sense of satisfaction of the oral tobacco composition is not lost.

In an illustrative implementation, the A/N ratio may be 0.05 or higher. When the A/N ratio is 0.05 or higher it becomes possible to suppress loss of a flavor component (herein, nicotine), derived from the tobacco material, in the production process of the oral tobacco composition.

Due to the presence of a given amount of the above carboxylic acid in the oral tobacco composition, the flavor component (herein, nicotine) is stably maintained by the acid also when the oral tobacco composition is used as a product that is directly exposed to air, for instance when the oral tobacco composition is used as snus. It becomes therefore possible to inhibit volatilization of the flavor component (herein, nicotine) contained in the tobacco composition.

The lower limit value of the A/N ratio is established from the viewpoint of reducing the characteristic feel and from the viewpoint of suppressing volatilization of the flavor component into air.

The total content of the one or more acids selected from the group consisting of citric acid, malic acid, succinic acid, acetic acid and formic acid in the tobacco composition is referred to the total amount of free acid.

The measurement method includes the following steps.

(1) Weighing the tobacco composition to be analyzed, and adding distilled water to the tobacco composition.

(2) Subjecting the composition to an ultrasonic treatment for 20 minutes using an ultrasonic cleaner, followed by transfer to a centrifuge tube.

(3) Arranging the centrifuge tube in a centrifuge, and performing centrifugation.

(4) Retrieving the aqueous layer and transferring the same to a centrifuge filter unit.

(5) Performing filtering on the centrifuge filter unit in a high-speed centrifuge, and using the resulting filtrate as an analysis sample.

(6) Analyzing the analysis sample in a high performance liquid chromatograph (HPLC) equipped with a UV detector, to isolate and quantify the sample.

From among the above acids, those at or below the detection limit or at or below the quantitation limit are regarded as having a content of 0 in the calculation of the A/N ratio.

The content of carboxylic acids having six or fewer carbon atoms in the oral tobacco composition of the present invention depends on the content of nicotine, but in an illustrative implementation may be from 0.01 wt % to 15.4 wt %, or alternatively from 0.01 wt % to 7.7 wt %, with respect to 100 wt % as the total weight of the dry tobacco material.

In an illustrative implementation, the content of nicotine contained in the oral tobacco composition of the present invention may be from 0.01 wt % to 10 wt %, or alternatively from 0.1 wt % to 5 wt %, with respect to 100 wt % as the total weight of the dry tobacco material.

The nicotine contained in the tobacco composition is quantified in accordance with the method DIN 10373 of the German Institute for Standardization.

The A/N ratio can be adjusted by modifying the content of the above acids contained in the tobacco leaves used as a material, by resorting to the production method of the present invention described below. The A/N ratio may be also adjusted by adding the above various acids, in accordance with the content of nicotine contained in the tobacco leaves.

In an illustrative implementation, the pH of the oral tobacco composition of the present invention may be from 7.0 to less than 10.0, or from 8.0 to less than 10.0. The purpose of pH adjustment is to adjust the taste of the oral tobacco composition. The oral tobacco composition of the present invention may also be neutralized as needed. The characteristic feel of the oral tobacco composition can be adjusted through adjustment of the A/N ratio, as described above.

A humectant such as glycerin, a sweetener for adjusting taste, and a fragrance for imparting a distinctive taste may be added to the oral tobacco composition of the present invention.

Further, water may be added to the tobacco composition of the present invention in order to achieve an appropriate moisture content in an oral tobacco product. The moisture content in the oral tobacco product may be from about 20 wt % to 50 wt %, with respect to 100 wt % as the weight of the oral tobacco product.

The oral tobacco composition of the present invention can be used in applications such as snus and gum, as described below.

In a case for instance where the oral tobacco composition of the present invention is to be made into snus, the snus can be obtained by filling the above-described tobacco material, in accordance with a known method, into a packaging material that utilizes for instance a starting material such as a nonwoven fabric. For instance, snus can be obtained by filling the tobacco composition while adjusting the amount of the composition, and by sealing the whole by resorting to a means such as heat sealing.

The packaging material that can be used is not particularly limited, but a cellulosic nonwoven fabric or the like is preferably used herein.

In a case for instance where the oral tobacco composition of the present invention is to be made into gum, the gum is obtained by mixing the above tobacco composition used in the present invention with a known gum base, in accordance with a known method. Chewing tobacco and snuff, and compressed tobacco as well, can be obtained in accordance with known methods, but utilizing herein the tobacco composition that is used in the present invention. Edible films likewise can be obtained using known materials and in accordance with known methods, but utilizing herein the above tobacco material that is used in the present invention.

In the method for producing an oral tobacco composition of the present invention a tobacco material obtained as a result of steps a) to e) below is incorporated into an oral tobacco composition.

a) step of adding a basic substance to a tobacco material;

b) step of heating the tobacco material having had the basic substance added thereto, to cause a flavor component in the tobacco material to be released into a gas phase;

c) step of recovering the flavor component having been released into the gas phase;

d) step of washing, using a washing solvent, the tobacco material from which the flavor component has been released, to remove thereby an acidic substance remaining in the tobacco material; and e) step of, after d), returning the flavor component recovered in b) to the tobacco material.

In an illustrative implementation, a ratio (A/N ratio) of total content of one or more acids selected from the group consisting of citric acid, malic acid, succinic acid, acetic acid and formic acid with respect to the content of a flavor component (herein nicotine) in the tobacco composition obtained in accordance with the production method of the present invention may be 2.00 or lower, and preferably 1.30 or lower. In an illustrative implementation, by contrast, the A/N ratio of the tobacco composition may be 0.05 or higher. As described below, the A/N ratio can be adjusted by adjusting the concentration of saccharides contained in the tobacco leaf material that is treated, by modifying the type of the basic substance that is added in step a), or by modifying the type of the number of washing runs and/or the washing solvent that is used in the washing step of step d).

The A/N ratio in the oral tobacco composition of the present invention may in some instances vary during storage after production, due to changes in the amount of the above acid. For instance, the A/N ratio may increase on account of generation of the above acid during storage of the oral tobacco composition.

The tobacco material that is subjected to the production method of the present invention may be shredded tobacco leaf, obtained through cutting of harvested tobacco leaves in accordance with ordinary methods. A tobacco powder can also be used as the tobacco material. The tobacco powder is obtained herein through crushing of harvested tobacco leaves in accordance with an ordinary method. The type of tobacco leaves that can be suitably used is not particularly limited, so long as the tobacco leaves can be used in oral tobacco. For instance a starting material of the genus *Nicotiana*, such as *Nicotiana tabacum* or *Nicotiana rustica*, can be used herein. Varieties of *Nicotiana tabacum* include for instance Burley varieties and flue-cured varieties. A tobacco material of type other than of Burley variety or flue-cured variety can be used as the type of the tobacco leaves. Known instances of shredded tobacco leaf and tobacco powders can be suitably used in terms of the width of the shredded tobacco leaf and the granularity of the tobacco powder.

In an illustrative implementation, the tobacco material used in the production method of the present invention may have a total content of saccharides of 10.0 wt % or less with respect to 100 wt % as the total weight of the dry tobacco material. The saccharides contained in the tobacco material are fructose, glucose, sucrose, maltose and inositol. When the content of these saccharides is 10.0 wt % or less with respect to the total weight of the dry tobacco material, it becomes possible to reduce emissions of volatile organic acids (mainly, acetic acid or formic acid) derived from decomposition of the saccharides during heating in step b) described below. As a result it becomes possible to reduce the amount of volatile organic acids that are collected simultaneous with recovery of the flavor component (herein, nicotine) in step c) described below.

The initial content, in the dry state, of the flavor component (herein, nicotine) contained in the tobacco material is preferably 2.0 wt % or more with respect to 100 wt % as the total weight of the tobacco material in a dry state. More preferably, the initial content of the flavor component (herein, nicotine) is 4.0 wt % or higher.

Step a) is a step of adding a basic substance to a tobacco material that contains a shredded tobacco leaf or tobacco powder. An alkaline tobacco material is prepared as a result of this step. In an illustrative implementation, the pH of the alkaline tobacco material may be 8.0 or higher, and may lie in the range of 8.5 to 10. In an illustrative implementation, preferably, the basic substance may be added to the tobacco material so that the pH of the material reaches the range of 8.9 to 9.7.

Examples of the basic substance that is added in order to make the tobacco material alkaline include for instance alkali metal salts of weak acids.

When the basic substance that is added in step a) is an alkali metal salt of a weak acid, the carboxylic acid salt remaining in the tobacco material can be removed efficiently in step d) described below. That is because alkali metal salts of carboxylic acids have high solubility in water. When the basic substance that is added in step a) is an alkali metal salt of a weak acid, moreover, it becomes possible to prevent that an alkali salt that is formed through neutralization with a volatile organic acid (mainly acetic acid or formic acid) contained in the tobacco material should volatilize and be released into the gas phase along with the flavor component (herein, nicotine) in step b) described below, since the boiling point of the alkali salt is sufficiently higher than the temperature during heating in step b). In a case where, for instance, an ammonium salt of a weak acid is used as the basic substance, the volatile organic acid volatilizes readily in the gas phase, since an ammonium salt of the volatile organic acid, formed through neutralization, decomposes more readily through heating than alkali metal salts.

Preferably, the weak acid in the above alkali metal salt of a weak acid has a pKa higher than that of the volatile organic acid (formic acid or acetic acid) in the tobacco material. Specifically, the weak acid is preferably carbonic acid. Release of the volatile organic acid into the gas phase in step b) described below can be expected to be suppressed as a result. In turn, this allows preventing the volatile organic acid from being recovered into the collecting solvent in a below-described collection step.

Concrete examples of the basic substance that is added in step a) include potassium carbonate and sodium carbonate.

Further examples of the basic substance that is used in step a) include for instance hydroxides of alkali metals, for instance sodium hydroxide and potassium hydroxide.

The pH of the tobacco material can be adjusted in step a) by using these basic substances.

The moisture content of the tobacco material is not particularly limited, and may be the moisture content of a tobacco material obtained through cutting of tobacco leaves having undergone ordinary drying, for instance from 5 wt % to 15 wt %. Preferably, the moisture content of the tobacco material may be high, for instance from 10 wt % or higher, and more preferably 30 wt %, in terms of release efficiency of the flavor component (herein, nicotine) in step b) described below. On the other hand, the moisture content is preferably 50 wt % or lower, from the viewpoint of heating the tobacco material efficiently in step b) described below.

The moisture content can be adjusted on the basis of the amount of water in the aqueous solution in which the basic substance is dissolved in step a) of adding the basic substance, or may be adjusted by adding water beforehand to the tobacco material before addition of the basic substance.

The salt concentration of the tobacco material can be adjusted through addition of an aqueous solution of sodium chloride to the tobacco material.

Step b) in the production method of the present invention is a step of causing the flavor component (herein, nicotine) contained in the tobacco material to be released, through heating the tobacco material having had the basic substance added thereto in step a).

In an illustrative implementation of step b), for instance, the tobacco material may be heated together with the vessel in which the tobacco material is accommodated and that is the vessel used at the time of addition of the basic substance. In an illustrative implementation, the vessel that is used in step b) may be made up of a member (for instance SUS) having heat resistance and pressure resistance. Examples of such an apparatus include for instance the apparatus 10 illustrated in FIG. 1. The apparatus 10 has a vessel 11 and a sprayer 12. In FIG. 1 the tobacco material corresponds to the reference symbol 50.

The vessel 11 of the apparatus 10 forms preferably an enclosed space in such a manner that the flavor component (herein, nicotine) does not volatilize towards the exterior. Herein the term "enclosed space" denotes a state in which entrance of solid foreign matter is prevented during normal handling (transport, storage and the like).

Addition of the basic substance in step a) may be performed using a sprayer 12.

The heating temperature of the tobacco material lies preferably in the range of 80° C. to less than 150° C. The timing of release of sufficient flavor component (herein, nicotine) from the tobacco material can be brought forward by virtue of the fact that the heating temperature of the tobacco material is 80° C. or higher. Due to heating temperature of the tobacco material being herein lower than 150° C. sufficient flavor component (herein, nicotine) can be released from the tobacco material while suppressing generation of unneeded substances caused by thermal decomposition of the tobacco material.

A water addition treatment may be performed on the tobacco material in step b). Preferably, the moisture content of tobacco material after the water addition treatment is from 10 wt % to 50 wt %. In step b) water may be added continuously to the tobacco material. Preferably, the water addition amount is adjusted in such a manner that the moisture content of the tobacco material is from 10 wt % to 50 wt %.

In step b), the tobacco material is preferably subjected to an aeration treatment. This allows increasing the amount of flavor component (herein, the amount of nicotine) contained in the release component that is released to the gas phase from the tobacco material having undergone an alkali treatment. In the aeration treatment for instance saturated water vapor at 80° C. is brought into contact with the tobacco material. The aeration time during the aeration treatment cannot be specified in a categorical manner, since it varies depending on the apparatus in which the tobacco material is treated and on the amount of the tobacco material. For instance, the aeration time lasts up to 300 minutes in the case of 500 g of tobacco material. The total aeration amount during the aeration treatment cannot be specified in a categorical manner, since it varies depending on the apparatus in which the tobacco material is treated and on the amount of the tobacco material. For instance, the total aeration amount is about 10 L/g in the case of 500 g of tobacco material.

The air in the aeration treatment need not be saturated water vapor. The moisture content in the air that is used in the aeration treatment may be adjusted for instance in such a manner that the moisture contained in the tobacco material subjected to the heating treatment and the aeration treatment is kept lower than 50%, without humidification of the tobacco material 50 being particularly pursued herein. The gas used in the aeration treatment is not limited to air, and may be an inert gas such as nitrogen or argon.

The production method of the present invention has step c) of recovering the flavor component (herein, nicotine) contained in the tobacco material and that is released as a result of the above step b).

The flavor component (herein, nicotine) released into the gas phase as a result of step b) is recovered from the gas phase in the course of step c). There is recovered the flavor component (herein, nicotine) contained in the gas phase inside the vessel that forms an enclosed space in step b), in a case where step c) is carried out in such vessel in order to prevent the flavor component (herein, nicotine) released into the gas phase from volatilizing to the exterior, as described above. In this case step b) and step c) may be carried out simultaneously.

In a case where step b) is carried out in a vessel that does not form an enclosed space, step c) is performed simultaneously with step b), so that the flavor component (herein, nicotine) can be recovered completely.

A method using a collecting apparatus may be resorted to herein as the recovery method of the flavor component (herein, nicotine). The collecting apparatus may be for instance an apparatus forming an enclosed space and that can hold a collecting solvent for recovery of the flavor component (herein, nicotine), such that the apparatus allows vapor in the gas phase containing the flavor component (herein, nicotine) to be brought into contact with the collecting solvent. Such a collecting apparatus may be for instance the collecting apparatus 20 illustrated in FIG. 2.

Figure 2:
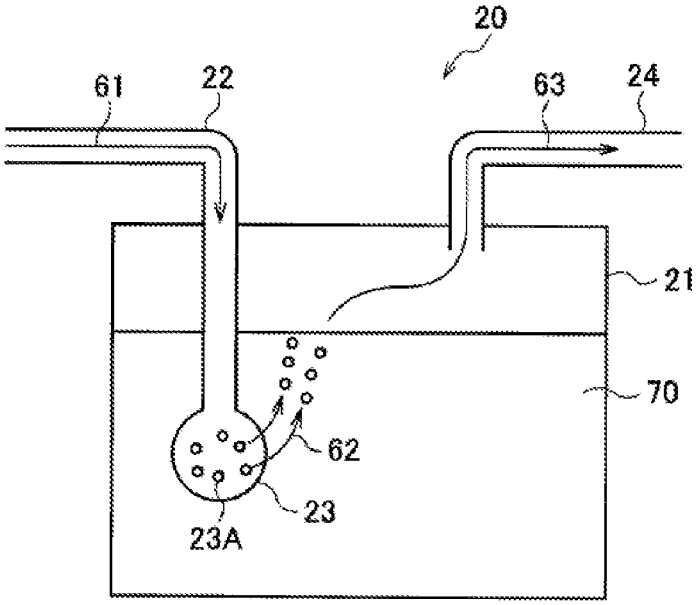
FIG. 2 is a diagram illustrating an example of an apparatus that can be used in a collection treatment.
Figure 3:
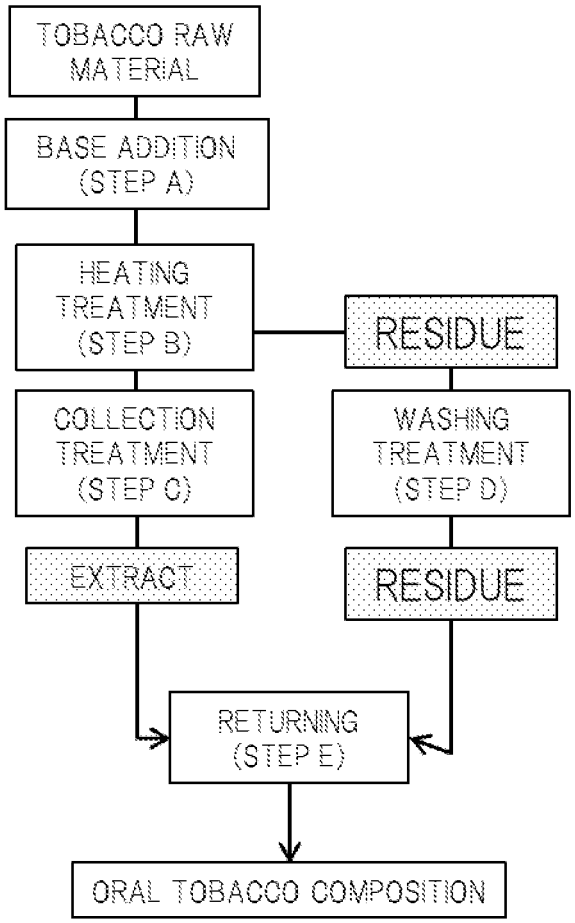
FIG. 3 is a flow diagram illustrating a method for producing an oral tobacco composition.

The collecting apparatus 20 of FIG. 2 has a vessel 21, a pipe 22, a release portion 23 and a pipe 24.

The vessel 21 holds a collecting solvent 70. The vessel 21 is for instance made up of glass. Preferably, the vessel 21 forms an enclosed space. Herein the term "enclosed space" denotes a state in which introduction of solid foreign matter is prevented during normal handling (transport, storage and the like).

The temperature of the collecting solvent 70 is for instance normal temperature. Preferably, the lower limit of normal temperature is for instance a temperature at which the collecting solvent 70 does not solidify, for instance 4° C. The upper limit of the normal temperature is for instance for instance 40° C. or lower. By setting the temperature of the collecting solvent 70 to lie in the range of 4° C. to 40° C. it becomes possible to efficiently remove, from the collecting solution, volatile undesireble components such as ammonium ions and pyridine while curtailing volatilization of the flavor component (herein, nicotine) from the collecting solution. For instance glycerin, water or ethanol can be used herein as the collecting solvent 70. Specifically, the collecting solvent 70 may be made up of a plurality of solvents. In order to enhance the capture efficiency of the flavor component (herein, nicotine), the initial pH of the collecting solvent 70 is preferably lower than the pH of the tobacco material 50 after treatment by the basic substance.

The release component 61 having been released into the gas phase from the tobacco material, by heating of the tobacco material, is led to the collecting solvent 70 through the pipe 22. Although not depicted in the figure, the pipe 22 of the collecting apparatus is connected to the vessel 11 of the apparatus 10.

The release portion 23 is provided at the tip of the pipe 22, and is immersed in the collecting solvent 70. The release portion 23 has a plurality of openings 23A. The release component 61 led by the pipe 22 is released through the openings 23A, into the collecting solvent 70, as a release component 62 in the form of bubbles.

The pipe 24 leads a residual component 63, not having been captured by the collecting solvent 70, to the exterior of the vessel 21.

The release component 62 is a component released into the gas phase as a result of heating of the tobacco material, and accordingly the temperature of the collecting solvent 70 may be raised by the release component 62. Therefore, the collecting apparatus 20 may have a function of cooling the collecting solvent 70 in order to maintain the temperature of the collecting solvent 70 at normal temperature.

The collecting apparatus 20 may have Raschig rings in order to increase the contact area of the release component 62 with the collecting solvent 70.

In an implementation of step c), the flavor component (herein, nicotine) that is released into the gas phase in step b) may be collected by being brought into contact with collecting solvent 70 at normal temperature, using the collecting apparatus 20 as described above. For convenience, step b) and step c) are explained as separate treatments, but it should be noted that step b) and step c) may be carried out in parallel. The term in parallel signifies that the period during which step b) is carried out and the period during which step c) is carried out overlap each other. It should also be noted that step b) and step c) need not start or end at the same time.

The pressure inside the vessel 11 of the apparatus 10 in step b) and step c) may be for instance normal pressure or lower. In further detail, the upper limit of the pressure inside the vessel 11 of the apparatus 10 is ordinarily +0.1 MPa or less, in terms of gauge pressure. The interior of the vessel 11 of the apparatus 10 may be a reduced-pressure atmosphere.

As described above, for instance glycerin, water or ethanol can be used as the collecting solvent 70. As described above, the temperature of the collecting solvent 70 is for instance normal temperature. The lower limit of normal temperature is for instance a temperature at which the collecting solvent 70 does not solidify, for instance 10° C. The upper limit of the normal temperature is for instance 40° C. or lower.

A concentrate is prepared by concentrating the collecting solvent containing the flavor component (herein, nicotine) having been collected in the collecting solvent 70, and subjecting the concentrate to step e). The concentrating conditions at the time of adjustment of the concentrate are not limited, and for instance may involve a condition of reduced pressure. In an illustrative implementation, the collecting solvent may be concentrated so that the concentration of the flavor component (herein, nicotine) is from 20 wt % to 30 wt %. The concentrating method is not particularly limited, and may be for instance a vacuum concentration treatment, a heat concentration treatment or a salting-out treatment.

The vacuum concentration treatment is performed in an enclosed space, and accordingly air contact is scant and there is no need for raising the temperature of the collecting solvent 70, due to which there is little concern of component change. Accordingly, more types of collecting solvent can be used if vacuum concentration is resorted to.

In a heat concentration treatment there arises a concern of liquid denaturation, for instance in terms of oxidation of the flavor component (herein, nicotine), although a flavor-reinforcing effect may on the other hand be achieved in some instances. The types of collecting solvent that can be used are however fewer than in vacuum concentration. For instance, it might not be possible to use a collecting solvent having an ester structure such as MCTs (medium chain triglycerides).

A salting-out treatment allows increasing the concentration of the flavor component (herein, nicotine) as compared with that obtained in a vacuum concentration treatment, but the yield of the flavor component (herein, nicotine) is poor, since the flavor component (herein, nicotine) becomes distributed half-and-half in the liquid solvent phase/aqueous phase. Further, salting-out might not be possible depending on the ratios of collecting solvent, water and flavor component (herein, nicotine), since the co-presence of a hydrophobic substance (for instance MCT) may be essential in some instances.

The flavor component (herein, nicotine) contained in the tobacco material is removed in step b), and thereafter the residue resulting from removal of the flavor component (herein, nicotine) is washed in step d) using a washing solvent. The acidic substance remaining in the tobacco material (residue) is removed as a result. The unneeded acidic substance can be removed from the tobacco material conveniently by including step d) in the production method of the present invention.

In a case where step d) is performed subsequent to step b) using the apparatus 10, washing may involve for instance spraying the washing solvent, from the sprayer 12, onto the tobacco material, followed by rotation and rocking of the vessel 11 for about 10 to 60 minutes.

The ratio by weight of the tobacco material and the washing solvent may lie in the range of 10 to 20, with 1 as the tobacco material.

The washing solvent used in step d) may be an aqueous solvent. For example, the washing solvent may be pure water or ultra-pure water, but urban water may likewise be used. The temperature of the washing solvent may be in the range of normal temperature to less than the boiling point of the washing solvent, preferably from normal temperature to 70° C.

A solvent having $CO_2$ gas bubbled therethrough may be used in a case where an aqueous solvent is used as the washing solvent. Specifically, the washing solvent may be carbonated water or an aqueous solution containing supersaturated $CO_2$ gas. For instance, water having ozone bubbled therethrough can be used as the aqueous solvent.

Herein step d) may be carried out a plurality of times; in a case where an aqueous solvent is used as the washing solvent, firstly washing may be performed using water, followed by washing using an aqueous solvent having $CO_2$ gas bubbled therethrough. Each washing course may be carried out a plurality of times. The acidic substance is removed efficiently through washing using such an aqueous solvent and in accordance with such a procedure.

Other than the above aqueous solvent, the washing solvent that is used may be a nonaqueous solvent such as propylene glycol, glycerin, ethanol, a MCT (medium-chain fatty acid triglyceride), hexane, methanol, acetonitrile or the like. The foregoing can be used in the form of a mixture with the above aqueous solvent.

A drying treatment may be performed on the resulting residue, after washing using the washing solvent. An illustrative implementation of the drying condition involves drying for about 100 to 150 minutes at a temperature of about 110° C. to 125° C., while under passage of air (ventilation volume: 10 to 20 L/min/250 g-shredded leaves)

The residue obtained as a result of the washing treatment in step d) is subjected to step e) described below.

Step e) is a step of returning the concentrate containing the flavor component (herein, nicotine), obtained in step c), to the residue obtained in the course of step d). In a case where step e) is carried out subsequent to step b) or d), using the apparatus 10, step e) may involve spraying the concentrate onto the residue out of the sprayer 12 of the apparatus 10, with rotation and rocking for about 10 to 20 minutes.

In step e) the amount of concentrate containing the flavor component (herein, nicotine) obtained in step c) and being returned to the residue obtained in the course of step d) does not exceed the amount of concentrate obtained in step d). Thus, the amount of the flavor component (herein, nicotine) returned to the residue does not exceed the amount originally contained in the tobacco material.

In step e) the concentrate containing the flavor component (herein, nicotine) is not returned to tobacco material (for instance, tobacco material not having undergone step b)) other than the residue obtained in the course of step d).

A step of sterilizing the tobacco material using for instance UV rays may be included before step a) or after step e). In a case where a sterilizing is included before step a), the temperature in the sterilizing step may for example lie in the range of 105° C. to 110° C. The time of the sterilizing step may be for instance about from 10 to 40 minutes.

In a case where a sterilizing step is included after step e), sterilizing can be implemented for instance through sealing in a negative-pressure state (gauge pressure of about −0.1 MPa), with heating for 15 to 45 minutes at about 105° C. in that sealed state.

The production method of the present invention may include a drying step and/or a moisture conditioning step for adjusting the moisture content of the tobacco composition that is obtained as a result of steps such as those described above. The moisture content can be adjusted to an appropriate value for an oral tobacco material by including a drying step and/or a moisture-conditioning step.

An illustrative implementation of the drying step may involve reducing the moisture content of the obtained tobacco composition down to about from 10 wt % to 40 wt %.

During drying the temperature of the tobacco composition may be raised up to 70° C. to 90° C.

In an illustrative implementation, the pH of the oral tobacco composition of the present invention may be from 7.0 to less than 10.0, or from 8.0 to less than 10.0. The purpose of pH adjustment is to adjust the taste of the oral tobacco composition. The oral tobacco composition of the present invention may also be neutralized, as needed. The characteristic feel of the oral tobacco composition can be adjusted through adjustment of the A/N ratio, as described above.

The production method of the present invention may include a step of adding, to the oral tobacco composition, a humectant such as glycerin, a sweetener for adjusting taste, and a fragrance for imparting a characteristic taste.

The production method of the present invention may include a step of adding water in order to achieve an appropriate moisture content in the oral tobacco composition. The moisture content in the oral tobacco composition may be of about from 20 wt % to 50 wt %, with respect to 100 wt % as the total amount of the oral tobacco composition.

A basic substance may be added to the oral tobacco composition obtained in accordance with the production method of the present invention, with a view adjusting the pH of the composition before being made into a product. Examples of the basic substance that is used include those illustrated in step a) above. In an illustrative implementation, the pH of the oral tobacco composition obtained in accordance with the production method of the present invention may be from 7.0 to less than 10, or from 8.0 to less than to 10.0.

Preferably, the production method of the present invention is implemented so as to satisfy all the conditions below. By virtue of this implementation a tobacco composition can be obtained that has an A/N ratio in the range of 0.05 to 0.20, without separate addition of an acid.

(1) The basic substance used in step a) is an alkali metal salt of carbonic acid.

(2) In the tobacco material to which the basic substance is added the total content of saccharides in the tobacco material is 10.0 wt % or less with respect to 100 wt % as the total weight of the dry tobacco material.

(3) In step a) an alkali metal salt of carbonic acid is added so that the pH of the tobacco material lies in the range of 8.9 to 9.7.

(4) The washing solvent used in step d) is water and/or carbonated water or an aqueous solution containing supersaturated $CO_2$ gas.

The oral tobacco composition obtained as a result of the above steps can be used in applications such as snus and gum, as described above. Conditions similar to those described above can be applied to the material and/or production method that are resorted to in a case where the composition is made into snus or gum.

Examples

The present invention will be explained next by way of examples, but is not limited to the disclosure of the examples below so long as the invention does not depart from the scope thereof.

Examples (Experimental Procedure)

A tobacco material (domestic Burley variety, having contents of each fructose, glucose, sucrose, maltose and inositol below the respective detection limit) was charged into the apparatus 10 illustrated in FIG. 1, and potassium carbonate, as the basic substance, was added to the tobacco material, to a concentration of 20 wt %. The moisture content of the tobacco material after addition of potassium carbonate was 40 wt %, and the pH was 9.7.

Thereafter the tobacco material was heated (jacket heating) at 120° C. while being ventilated with ambient air (ventilation volume 15 L/min/500 g-shredded leaves). The heating time was set to 150 minutes.

The release component that was released into the gas phase during heating of the tobacco material was collected using the collecting apparatus 20 illustrated in FIG. 2. Glycerin was used as the collecting solvent, and the temperature of the collecting solvent was set to 4° C. (jacket cooling). The obtained collecting solvent was concentrated under conditions of pressure 25 mmHg and bath temperature 37° C., so that the concentration of the flavor component (herein, nicotine) was about 20 wt %, to yield a concentrate.

A heating treatment was carried out, and a wash solution was charged into the apparatus 10 in which there remained the tobacco material having had the flavor component (herein, nicotine) removed therefrom, to a weight ratio of the tobacco material and the wash solution of 1:15, and the apparatus was rotated and rocked for 30 minutes. This operation was repeated using hot water at 60° C., as the wash solution, the first time, using hot water at 60° C. the second time, using normal-temperature water+$CO_2$ bubbling (10 L/min) the third time, and using normal-temperature water+$CO_2$ bubbling (10 L/min) the fourth time.

The interior of the apparatus 10 was dried at a heating temperature of 120° C. (jacket heating), ventilation volume of 15 L/min/250 g-shredded leaves, treatment time 120 minutes, to dry the residue of the tobacco material.

Thereafter, the tobacco material having been dried was sprayed with the above concentrate, from the sprayer 12, inside the apparatus 10. Spryaing was performed for 15 minutes while rotating and rocking the apparatus 10, in such a manner that the tobacco material was homogeneity sprayed with the concentrate.

Thereafter, the interior of the apparatus 10 was depressurized and sealed, in a negative-pressure state (gauge pressure: −0.1 MPa). Sterilization was then performed in this sealed state through heating for 15 to 45 minutes at 105° C. (jacket heating). Then the jacket was cooled to revert the apparatus to normal temperature, after which vacuum was released, to yield a tobacco composition (nicotine content of 5.37 wt % and moisture content of 16.9 wt % with respect to 100 wt % as the dry tobacco weight).

To the tobacco composition (Sample 1) obtained as a result of the above operation there was added an acid (malic acid) (Samples 3 to 7), and a basic substance (NaOH) (Samples 3 and 5 to 8), to adjust thereby the pH and the A/N ratio of the tobacco compositions as given in Table 2, and prepare respective samples. Sample 2 was obtained by performing the same operation as in Sample 1, using the same tobacco material as in Sample 1, but setting the subsequent storage period to be different from that of Sample 1. In Sample 8 the above-described operation was not performed on the tobacco material used to produce Sample 1.

The nicotine content and the content of the respective acids in Sample 1 were as given in Table 1. In the table, ND represents detection limit or lower, and NQ represents quantitation limit or lower. Since malic acid and citric acid were at or below the detection limit, the content of the foregoing was equated to 0 when calculating the A/N ratio. Succinic acid as well was at or below the quantitation limit, and hence the content of the foregoing was equated to 0 when calculating the A/N ratio.

The content of acids at or below the quantitation limit in Samples 1 to 8 was equated to 0 in the calculation of the A/N ratio.

TABLE 1

| | mg/g DB |
|---|---|
| Nicotine | 53.70 |
| Acetic acid | 0.47 |
| Formic acid | 0.36 |
| Malic acid | ND |
| Citric acid | ND |
| Succinic acid | NQ |

The characteristic feel of the tobacco composition of Samples 1 to 8 during use (notated as "characteristic feel" in Table 2) was subjected to sensory evaluation. The results are given in Table 2. The sensory evaluation was performed by five subjects, and the perception of the characteristic feel was substantially identical across the subjects. The characteristic feel perceived by the subjects at the time of the test is given in the column "Characteristic feel" of Table 2. The "characteristic feel" denotes the degree of feel specific to the tobacco material, via the saliva. The characteristic feel is quantified in the form of a numerical value by assigning 10 to the untreated tobacco material and 0 to the absence of feel. Depending on the subject the characteristic feel of the tobacco material may be perceived as irritating.

TABLE 2

| Sample name | A/N | pH | Acid added | Base added | Characteristic feel |
|---|---|---|---|---|---|
| Sample 1 | 0.05 | 8.7 | No | No | 0 |
| Sample 2 | 0.06 | 8.9 | No | No | 1 |
| Sample 3 | 0.20 | 8.7 | Yes | Yes | 3 |
| Sample 4 | 0.20 | 3.9 | Yes | No | 3 |
| Sample 5 | 1.30 | 8.8 | Yes | Yes | 6 |
| Sample 6 | 2.00 | 8.7 | Yes | Yes | 8 |
| Sample 7 | 3.50 | 8.7 | Yes | Yes | 10 |
| Sample 8 (untreated) | 3.51 | 8.7 | No | Yes | 10 |

The results given in Table 2 revealed, in a comparison between Samples 3 and 4, that the characteristic feel remains constant if the A/N ratio is constant, regardless of the value of pH. A comparison between Samples 1 to 3 and 5 to 7 revealed that when pH is substantially constant, the characteristic feel varies with varying A/N ratio.

The results of Samples 1 to 5 revealed that the characteristic feel drops sufficiently, as compared with an untreated sample, when the A/N ratio is 1.3 or lower. In Samples 1 to 5, by contrast, desirable sensations other than the characteristic feel of the tobacco material were unaffected. Sample 6 exhibited a greater reduction in characteristic feel than Sample 8 (untreated tobacco leaves). The tobacco material having had the A/N ratio adjusted in accordance with the production method of the present invention exhibited a greater reduction in characteristic feel than an untreated tobacco material.

As described above, loss of the flavor component (herein, nicotine) contained in the tobacco material can be prevented when there is present a carboxylic acid having six or fewer carbon atoms and contained in the tobacco material. According to the results of Samples 1 to 7, if the A/N ratio lies in the range of 0.05 to 2.00 it becomes possible to reduce the characteristic feel with respect to that of the untreated starting material, while suppressing loss of the flavor component (herein, nicotine); if the A/N ratio lies in the range of 0.05 to 1.30, it becomes possible to sufficiently reduce the characteristic feel as compared with the untreated starting material.

Reference Example

The total content of one or more acids selected from the group consisting of citric acid, malic acid, succinic acid, acetic acid and formic acid in untreated tobacco leaves was measured. The measured tobacco leaves were a total of 104 samples including flue-cured variety: 58 samples; Burley variety: 28 samples and Orient variety: 18 samples. The A/N ratios of untreated tobacco leaves were classified by type in Table 3. Table 4 summarized the A/N ratios of the untreated tobacco leaves classified by content of nicotine.

As a result the A/N ratios lay in the range of 1.37 to 19.56 (average value: 4.70).

A summary of the samples by variety and by nicotine wt % (dry basis) in the starting material was as follows.

It can be inferred that the characteristic feel is reduced in Samples 1 to 5 to a greater extent than in the case of untreated tobacco leaves.

TABLE 3

| | A/N ratio | | |
|---|---|---|---|
| Division | Minimum value | Average value | Maximum value |
| Flue-cured variety | 1.37 | 3.66 | 12.46 |
| Burley variety | 1.66 | 4.24 | 9.12 |
| Orient variety | 1.74 | 8.78 | 19.56 |

TABLE 4

| | Nicotine in | A/N ratio | | |
|---|---|---|---|---|
| Division | material (wt %-DB) | Minimum value | Average value | Maximum value |
| Division A | From 0 to less than 1.5 | 4.01 | 10.39 | 19.56 |
| Division B | From 1.5 to less than 2.5 | 1.74 | 5.54 | 9.12 |
| Division C | From 2.5 to less than 3.5 | 1.37 | 2.77 | 5.55 |
| Division D | From 3.5 to less than 4.5 | 1.75 | 2.21 | 2.99 |
| Division E | 4.5 or more | 1.66 | 2.01 | 2.38 |

Quantitative determination of the acid contained in the tobacco composition was carried out in accordance with the procedure below.

1) Herein 2 g of the tobacco composition to be analyzed were weighed in a screw tube (by AS ONE Corporation) having a volume of 30 ml, with addition of 25 ml of distilled water.

2) An ultrasonic treatment was performed for 20 minutes in an ultrasonic cleaner (US-106, by NND Co., Ltd.), followed by transfer to a centrifuge tube.

3) The centrifuge tube was set in a centrifuge (H-103N, by Kokusan Co. Ltd.), and was centrifuged for 5 minutes at 3500 rpm.

4) The aqueous layer was retrieved and was transferred to an Ultrafree-MC Centrifugal Filter Unit.

5) The aqueous layer was set in a table-top high-speed centrifuge (KINTARO-18, by Tomy Seiko Co., Ltd.), and filtration was carried out at 12,000 rpm for about 10 seconds, with the resulting filtrate serving as an analysis sample.

6) The analysis sample was isolated and quantified using a high performance liquid chromatograph (HPLC) equipped with a UV detector.

The nicotine contained in the tobacco composition was quantified in accordance with the procedure below.

Quantitation was carried out in accordance with the method DIN 10373 of the German Institute for Standardization. Specifically, 250 mg of the tobacco composition were sampled, 7.5 mL of a 11% aqueous solution of sodium hydroxide plus 10 mL of hexane were added to the sample, and the sample was extracted through shaking for 60 minutes. After extraction, the supernatant hexane phase was set in a gas chromatograph-mass spectrometer (GC/MS), to quantify the nicotine weight contained in the tobacco composition.

<pH Analysis Method>

Herein 400 mg of the oral tobacco composition were sampled, 4 mL of the pure water were added to the sample, and extraction was carried out for 60 minutes through shaking.

The temperature of the resulting extract was adjusted by allowing the same to stand in a sealed container down to room temperature, in a laboratory controlled to room temperature of 22° C.

After temperature adjustment, the lid was opened, the glass electrode of a pH meter (by Mettler-Toledo International Inc.: SevenEasy S20) was immersed in the collection solution, and the measurement was initiated. The pH meter had been calibrated beforehand using pH meter calibration solutions at pH 4.01, 6.87 and 9.21. The point at which the output fluctuation from the sensor stabilized within 0.1 my in 5 seconds was taken herein as the pH of the extraction solution.

In the oral tobacco composition of the present invention, the feel in the throat and esophagus that is characteristic of a tobacco material can be selectively eliminated by virtue of the fact that the ratio of the contents of a specific acid and of nicotine are set to lie within a predetermined range. The production method of the present invention allows producing a tobacco composition in which the ratio of the contents of a specific acid and of nicotine lie within a predetermined range.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The present application is a continuation application of International Application No. PCT/JP2015/051769, filed Jan. 23, 2015, which claims priority to International Patent Application No. PCT/JP2014/078402, filed Oct. 24, 2014. The contents of these applications are incorporated herein by reference in their entirety.

What is claimed is:

1. An oral tobacco composition, wherein a molar ratio (A/N ratio) of total content of citric acid, malic acid, succinic acid, acetic acid and formic acid with respect to content of nicotine is 0.20 or lower.

2. The oral tobacco composition according to claim 1, wherein the A/N ratio is 0.05 or higher.

3. The oral tobacco composition according to claim 1, wherein pH of the oral tobacco composition is 8.0 to less than 10.0.

4. A method for producing an oral tobacco composition containing a tobacco material, the method comprising:

a) step of adding a basic substance to a tobacco material;

b) step of heating the tobacco material, to which the basic substance has been added, to cause a flavor component in the tobacco material to be released into a gas phase;

c) step of recovering in the tobacco material to be released into a gas phase;

d) step of washing by using a washing solvent the tobacco material, from which the flavor component has been released, to remove thereby an acidic substance remaining in the tobacco material; and e) step of, after the d), returning the flavor component recovered in the b) to the tobacco material, so that total content of saccharides in the tobacco material is 10.0 wt % or less with respect to 100 wt % as total weight of the tobacco material in a dry state.

5. The production method according to claim 4, wherein the basic substance comprises an alkali metal salt of weak acid.

6. The production method according to claim 5, wherein the alkali metal salt of weak acid is an alkali metal salt of carbonic acid.

7. The production method according to claim 4, where in the step a) the basic substance is added to the tobacco material so that pH of the tobacco material reaches a range of 8.9 to 9.7.

8. The Production method according to claim 4, wherein the washing solvent is water and/or carbonated water, or an aqueous solution containing supersaturated $CO_2$ gas.

9. the production method according to claim 4, wherein a ratio (A/N ratio) of total content of one or more acids selected from the group consisting of citric acid, malic acid, succinic acid, acetic acid and formic acid with respect to content of nicotine in the obtained tobacco material is 2.00 or lower.

10. The production method according to claim 4, wherein a ratio (A/N ratio) of total content of one or more acids selected from the group consisting of citric acid, malic acid, succinic acid, acetic acid and formic acid with respect to content of nicotine in the obtained tobacco material is 1.30 or lower.

11. The production method according to claim 4, wherein a ratio (A/N ratio) of total content of one or more acids selected from the group consisting of citric acid, malic acid, succinic acid, acetic acid and formic acid with respect to content of nicotine in the obtained tobacco material is 0.05 or higher.

* * * * *